US005167406A

United States Patent [19]

Cole, Jr.

[11] Patent Number: 5,167,406

[45] Date of Patent: * Dec. 1, 1992

[54] APPARATUS FOR AUTOMATICALLY INVERTING WORKPIECES OF LIMP SHEET MATERIAL

[75] Inventor: William R. Cole, Jr., Shelbyville, Tenn.

[73] Assignee: Ark, Inc., Shelbyville, Tenn.

[ * ] Notice: The portion of the term of this patent subsequent to Aug. 20, 2008 has been disclaimed.

[21] Appl. No.: 724,744

[22] Filed: Jul. 2, 1991

Related U.S. Application Data

[63] Continuation-in-part of Ser. No. 553,993, Jul. 16, 1990, Pat. No. 5,040,778.

[51] Int. Cl.[5] ..... B65H 5/22

[52] U.S. Cl. ..... 271/6; 271/7; 271/186

[58] Field of Search ..... 271/18.3, 65, 178, 184, 271/185, 186, 175, 3, 4, 6, 7; 198/402, 403, 404, 410, 380; 223/43

[56] References Cited

U.S. PATENT DOCUMENTS

| | | | |
|---|---|---|---|
| 3,034,632 | 5/1962 | Wampler | 198/33 |
| 3,198,513 | 8/1965 | Farez | 271/65 |
| 3,355,165 | 11/1967 | Southwell et al. | 271/65 |
| 3,370,849 | 2/1968 | Martin | 271/68 |
| 3,549,145 | 12/1970 | Troutman | 271/184 |
| 3,603,587 | 9/1971 | Van Dorst | 271/65 |
| 4,020,941 | 5/1977 | Kennedy | 198/402 |
| 4,027,580 | 6/1977 | Sundin | 93/93 |
| 4,175,655 | 11/1979 | Baldwin | 198/403 |
| 4,583,727 | 4/1986 | Fort | 271/19 |
| 4,645,193 | 2/1987 | Walton | 271/18.3 |

*Primary Examiner*—H. Grant Skaggs
*Assistant Examiner*—Carol Lynn Druzbick
*Attorney, Agent, or Firm*—Senniger, Powers, Leavitt & Roedel

[57] ABSTRACT

Apparatus for automatically inverting workpieces of limp sheet material, such as fabric sheet material, including an endless primary conveyor having a forward-traveling reach for conveying workpieces in a forward direction, each workpiece having a leading edge and a trailing edge. A gripper engages a portion of the workpiece generally adjacent its leading edge as the workpiece travels on the primary conveyor and holds the leading edge portion stationary. The primary conveyor includes a series of flights spaced at intervals therealong with openings between the flights. The trailing edge of the workpiece and the adjacent trailing edge portion drop through an opening between a leading flight and a trailing flight after the gripper engages and holds stationary the leading edge portion. A pushing mechanism acts on the trailing edge portion of the workpiece for pushing the trailing edge portion forardly to invert the trailing edge portion as the leading edge portion is held stationary by the gripper. The leading edge portion of the workpiece is released from the gripper after the trailing edge portion of the workpiece has been inverted, whereupon the workpiece is in a generally flat, inverted position in which the leading edge is rearward of the trailing edge.

10 Claims, 8 Drawing Sheets

APPARATUS FOR AUTOMATICALLY INVERTING WORKPIECES OF LIMP SHEET MATERIAL

TheU.S. Government has a paid-up license in this invention and the right in limited circumstances to require the patent owner to license others on reasonable terms as provided for by the terms of contract No. DLA 900-87-C-0509 awarded by the Department of Defense.

This is a continuation-in-part of U.S. application Ser. No. 553,993, filed Jul. 16, 1990, now U.S. Pat. No. 5,040,778.

BRIEF SUMMARY OF THE INVENTION

This invention relates to apparatus for inverting workpieces and more particularly to apparatus for automatically inverting workpieces of limp sheet material, such as fabric sheet material.

A common method of cutting fabric workpieces or "plies" for manufacturing articles of apparel results in the production of stacks of plies in each of which the plies are positioned with the outer surface of the fabric alternately facing up and down. More particularly, the method involves "fan-folding" a roll of fabric onto a cutting table by passing the roll back and forth across the table while letting out fabric onto the table to form the spread. The pattern for the ply required (e.g., for producing a shirt collar) is placed on the top surface of the spread, and the spread is cut through all of its layers resulting in a stack of plies. Where the pattern is asymmetrical, the cut produces left and right hand plies, meaning that when adjacent plies in the stack are viewed from their outer surfaces, the periphery of each ply is a mirror image of the other.

For purposes of later manipulation of the plies, such as sewing, it is necessary that every other ply be turned so that the same surface (i.e., outer surface) of the fabric faces upward. In addition, markings indicating the location in the fabric roll from which the ply was cut are needed to assure that plies cut from the same area in the fabric roll are used to make an article of apparel. "Shade numbering" assures that there will be no shade differences between the component pieces of each article of apparel made. These tasks may be carried out by hand; however it is very tedious for the worker and not particularly cost efficient. One solution is to carry out the task with automatic machinery. However, because the plies are of limp sheet material, it is difficult to turn them over with automatic machinery without inadvertently folding over an edge of the sheet of material. In order to carry out operations on the ply with other automatic machinery, such as an automatic sewing machine, the plies must lie completely flat and unfolded when they reach the sewing work station. Further, it is desirable to perform the inversion of the plies as they are being transported to or from a work station, such as on a conveyor.

In addition, where the individual plies in the stack are left or right handed, it is frequently necessary to separate the like handed plies into separate stacks for later processing.

Among the several objects of the present invention may be noted the provision of apparatus for automatically and efficiently inverting workpieces, and more particularly for automatically and efficiently inverting plies of limp fabric sheet material; the provision of such apparatus which marks one face of the workpieces for later identification; the provision of such apparatus which selectively inverts and separates plies into stacks of like shaped plies; and the provision of such apparatus which effects complete inversion of a workpiece so that it lies flat and unfolded on the conveyor after inversion thereof.

In general, apparatus constructed according to the principles of the present invention for inverting workpieces of limp material comprises an endless primary conveyor having a forward-traveling reach for conveying workpieces in a forward direction. The primary conveyor comprises a series of flights spaced at intervals therealong with openings between the flights. Gripper means engages a portion of the workpiece generally adjacent its leading edge as the workpiece travels on the primary conveyor, and holds the leading edge portion stationary such that the trailing edge and at least part of a portion of the workpiece generally adjacent its trailing edge drops through an opening between the flight supporting the workpiece and a trailing flight of the primary conveyor. Pusher means is adapted to act on the trailing edge portion of the workpiece for pushing the trailing edge portion forwardly to invert the trailing edge portion. The leading edge portion of the workpiece is released from the gripper means after the trailing edge portion of the workpiece has been inverted, whereupon the workpiece is in a generally flat, inverted position with its leading edge rearward of its trailing edge.

In another aspect of the present invention, apparatus for automatically inverting and marking workpieces of limp sheet material, such as fabric sheet material comprises an endless primary conveyor, (first) gripper means and pusher means as described above. In addition, the apparatus includes an endless secondary conveyor having a forward-traveling reach for conveying workpieces in a forward direction, and at least a portion of the forward-traveling reach of the secondary conveyor is located under the forward traveling reach of the primary conveyor. The secondary conveyor comprises a series of flights spaced at intervals therealong with openings between the flights. First means located above the forward-traveling reach of the primary conveyor rearward of the gripper means marks with an identifying reference mark workpieces having their first faces facing upward prior to inversion by the apparatus. Second means located above the forward-traveling reach of the secondary conveyor and forward of the gripper means marks with an identifying reference mark inverted workpieces having their first faces facing upward subsequent to inversion by the apparatus.

In still another aspect of the present invention, apparatus for inverting and separating workpieces of limp sheet material, such as fabric sheet material comprising an endless primary conveyor, (first) gripper means, pusher means and an endless secondary conveyor as described in the preceding paragraph. In addition, the apparatus includes first means for holding a stack of workpieces located under the forward-traveling reach of the secondary conveyor, and second means for holding a stack located under the forward-traveling portion of the primary conveyor rearward of said gripper means. Second gripper means engages a portion of the workpiece as the workpiece travels on the secondary conveyor and holds the workpiece stationary, whereby the flight on which the workpiece rests slides out from under the workpiece and the workpiece is deposited on the second means for holding a stack. Third gripping means engages a portion of the workpiece as the workpiece travels on the primary conveyor flight and holds the workpiece stationary, whereby the flight slides out from under the workpiece and the workpiece is deposited on the second means for holding a stack.

Other objects and features will be in part apparent and in part pointed out hereinafter.

BRIER DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
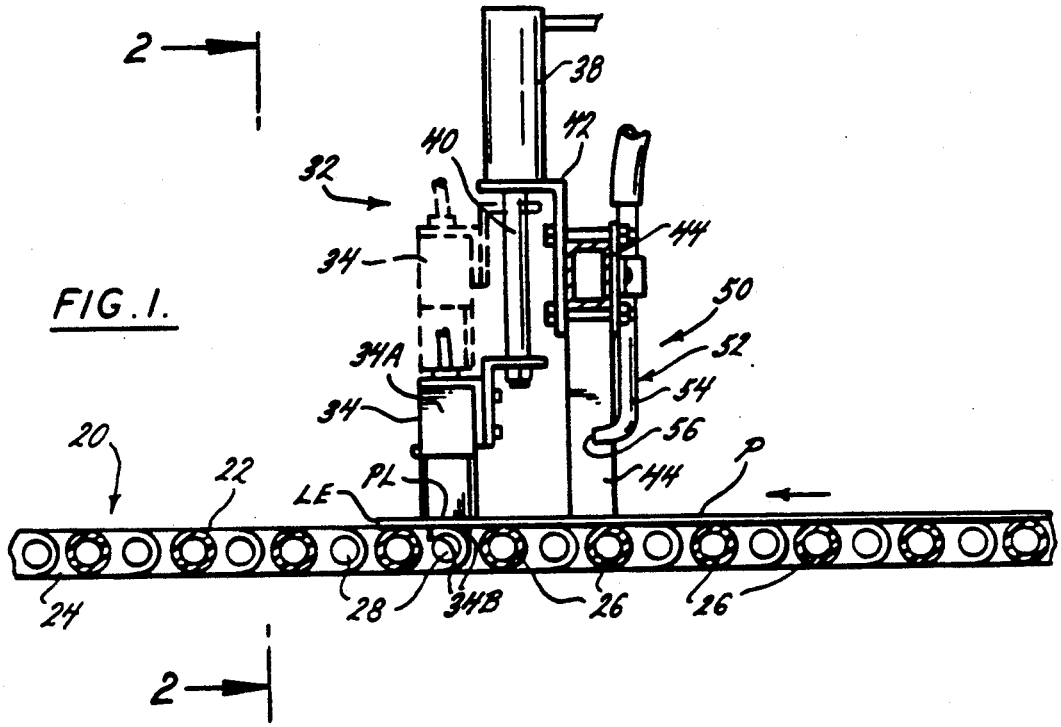
FIG. 1 is a side elevation of the apparatus of a first embodiment of the present invention showing pick-up means in its grasping position (solid lines) and in its raised position (in phantom)

Referring to the drawings, apparatus of this invention for automatically inverting workpieces of limp sheet material, such as plies P of fabric sheet material, is shown to comprises an endless conveyor 20 having a forward-traveling upper reach 22 for conveying plies in a forward direction (from right to left as viewed in FIG. 1). Although the apparatus is particularly adapted for turning over plies of fabric, it is contemplates that its principles are applicable to apparatus for inverting other workpieces of limp sheet material. Only the portion of the upper reach 22 of the conveyor necessary for an understanding of the present invention has been illustrated in the drawings. The conveyor 20 is substantially the same as the conveyor disclosed in my co-pending, co-assigned application Ser. No. 07/445,539, filed Dec. 4, 1989, which is incorporated herein by reference. Briefly described, the conveyor 20 comprises a pair of endless chains 24 which are driven by suitable means (such as motor 25 shown in Ser. No. 445,539). The surface of the conveyor 20 is made up of rods 26 extending transversely with respect to the chains 24 of the conveyor. The chains 24 have pins 28 extending inwardly form the inside of the chains (see FIGS. 1 and 2). The rods 26 are tubular flexible plastic rods (e.g. nylon rods each mounted at its ends on two of these pins 28 which extend inwardly form the left and right hand chains 24 in axial alignment with each other. Each rod 26 is mounted on its respective pair of pins 28 be bending it to fit between the inner ends of the pins and then allowing it to straighten out and slip onto the pins. In a preferred form of the conveyor 20, the surface of the conveyor 20 is formed by channel-shaped aluminum slats 30 which may be connected between the chains 0.24. The slats 30 are made of 0.031 aluminum sheets with 0.25 inch turned-down flanges. The width of each slat 30 is approximately 0.625 inch and its length is about 24 inches. The ends of the sheets are turned down and two holes 31 are drilled in them for receiving the pins 28 to connect the slat to the conveyor chain 24. It is to be understood that the slats 30 may have other dimension and/or be made of other materials and still fall within the scope of the present invention. The slats 30 can be positioned together in close edge to edge relationship so that the slats form a substantially continuous upper surface for the conveyor 20. As will be explained more fully below, particularly in regard to the apparatus of the first embodiment, other types of conveyors may also be used in the apparatus and fall within the scope of the present invention.

Figure 2:
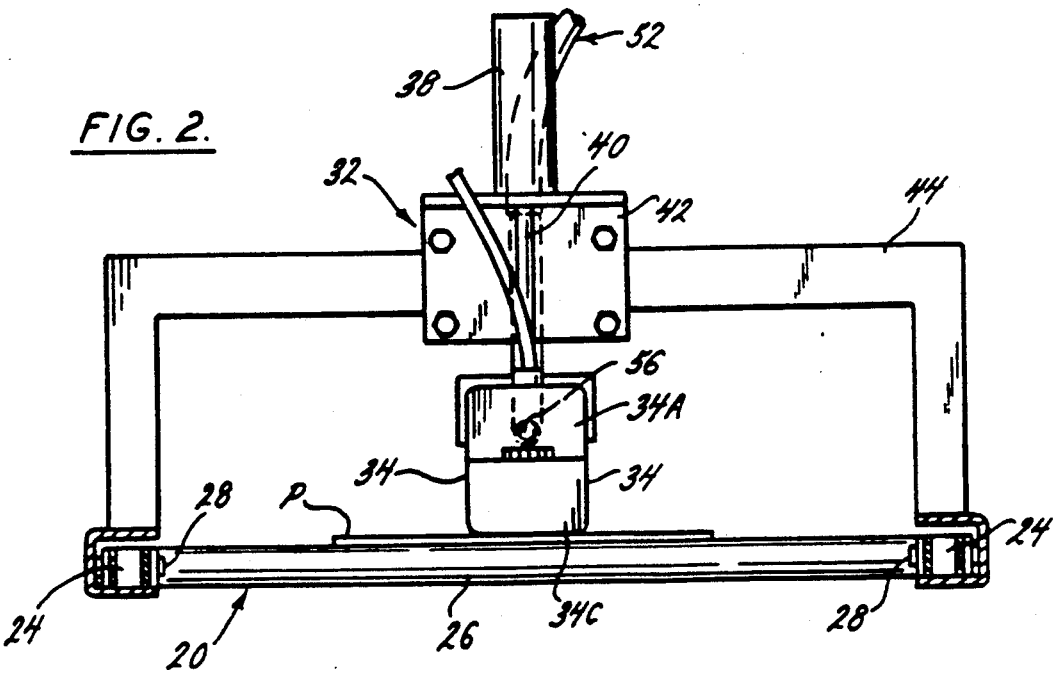
FIG. 2 is a section of the apparatus taken in the plane including line 2—2 of FIG. 1.

Gripper means indicated generally at 32 is provided for grasping a portion of the workpiece or "ply" P adjacent its leading edge LE as the workpiece travels forward on the conveyor. In the embodiments shown in FIGS. 1–12, the gripper means 32 includes a fabric gripper 34 manufactured by Arato Engineering of Switzerland and made available in the United States by E & E Engineering, Inc. of Detroit, Mich. Briefly described, the gripper has a body 34A which houses a plurality of steel needles 34B (see FIG. 3) which are selectively extensible by the application of air pressure from a gripping face 34C on the lower end of the body. When the needles 34B are extended, they project downwardly from the gripping face 34C at angles oblique to the vertical (some of the needles are angled in laterally opposite directions such that they cross each other, thus providing the gripping action). In use, the gripping face 34C is engaged with the ply P and the needles 34B are extended to pierce and grip the ply. The gripper means 32 of the embodiments of the apparatus shown in FIGS. 1–12 further includes an air cylinder 38 having an extensible and retractable rod 40. As shown in FIGS. 1 and 2, the cylinder 38 is mounted by a bracket 42 on a support 44 extending transversely over the conveyor 20, and the gripper 34 is mounted on the rod 40 for motion downward from its raised position (shown in phantom in FIG. 1) to grasp a leading edge portion PL of the ply P, and upward to lift the leading edge portion off the conveyor 20.

Figure 3:
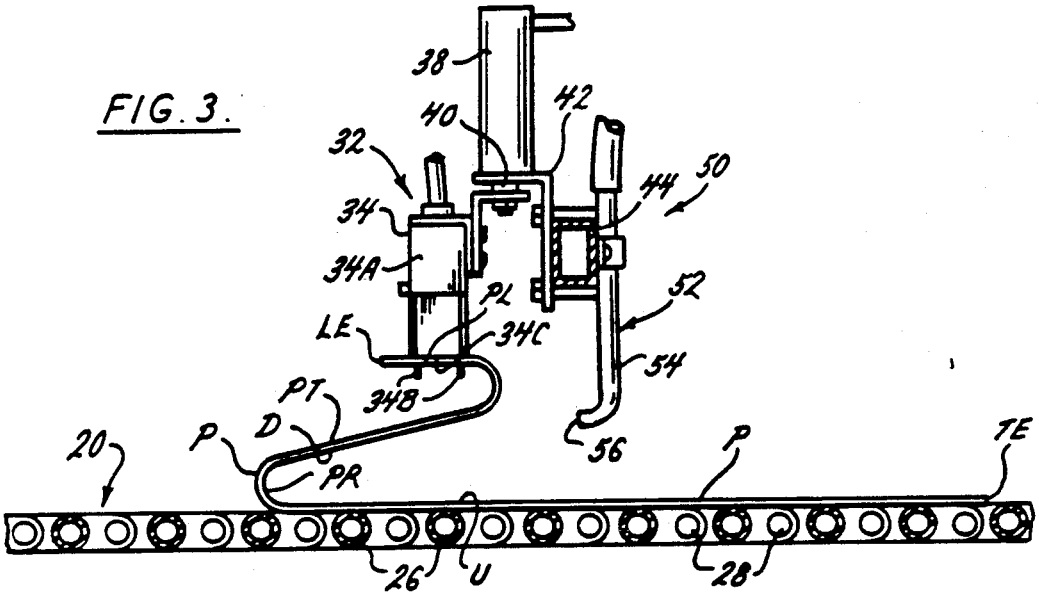
FIGS. 3–5 illustrate inversion of a workpiece of limp sheet material by the apparatus of the first embodiment.
Figure 6:
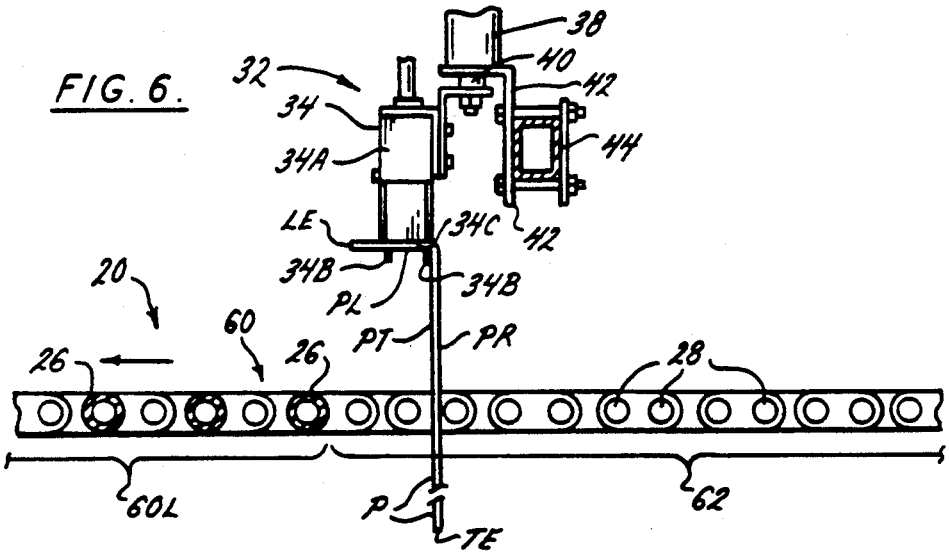
FIGS. 6–8 illustrate inversion of a workpiece of limp sheet material by apparatus of a second embodiment.
Figure 7:
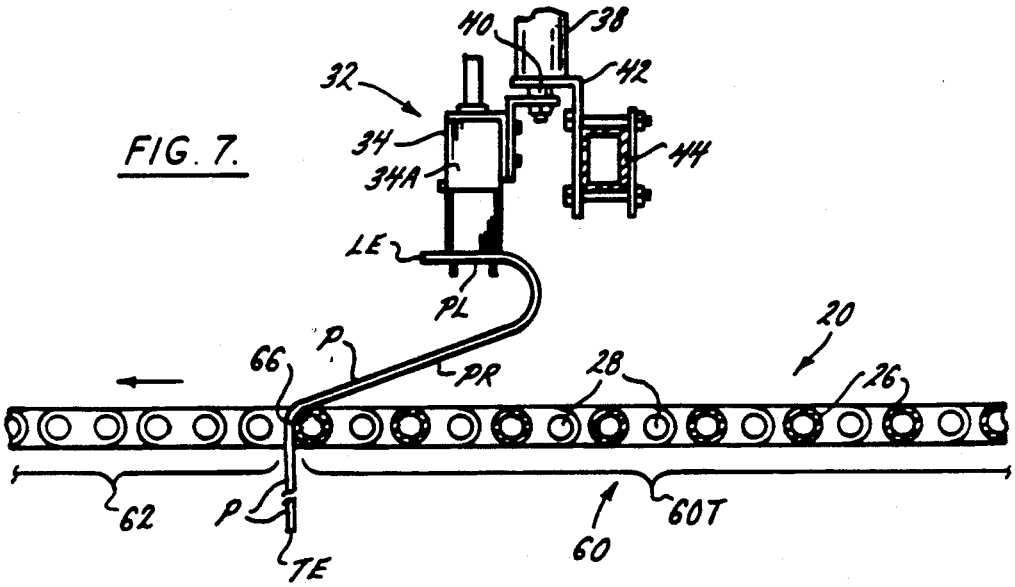

As shown in FIGS. 3 and 6, when the leading edge portion PL of the ply P is lifted off the conveyor 20 and held in the raised position by the gripper means 32, a trailing portion PT of the ply P extends downwardly from the gripper 34 and contacts the conveyor. Thus, the trailing portion PT tends to move forwardly on the conveyor 20 beneath the leading edge portion PL, toward an inverted position (FIGS. 2 and 7). Although continued forward movement of the trailing portion PT (as the leading edge portion PL is held stationary) tends to turn over the trailing portion PT, this frequently does not result in complete inversion of the workpiece. For instance, as the trailing portion PT is carried forward from the position shown in FIG. 3, the generally downwardly facing surface D of an upper part of the ply will come into contact with the upwardly facing surface U of a lower portion of the ply. The frictional force between engaging surfaces D and U of the ply is often greater than the frictional force between the ply and the conveyor 20. Therefore, rather than turning over, the trailing edge TE of the ply remains folded under the forwardmost portion of the ply. This is entirely unsuitable for further operations, such as sewing, which require that the sheet of material lie unfolded and substantially flat on the conveyor 20.

Figure 5:
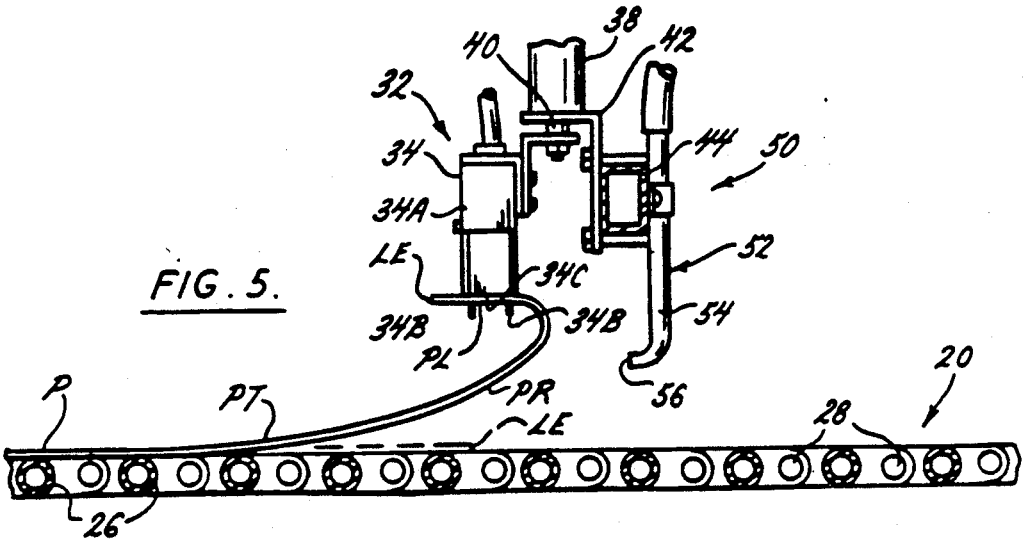
Figure 9:
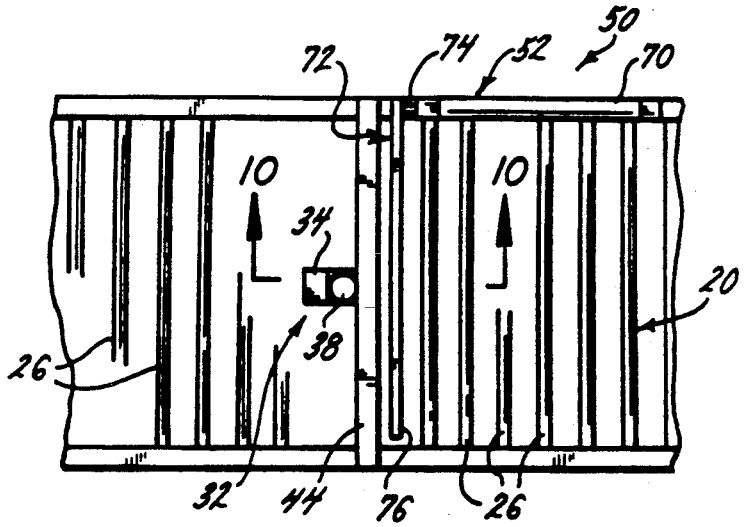
FIG. 9 is a plan view of apparatus of a third embodiment with portions broken away to show detail.
Figure 11:
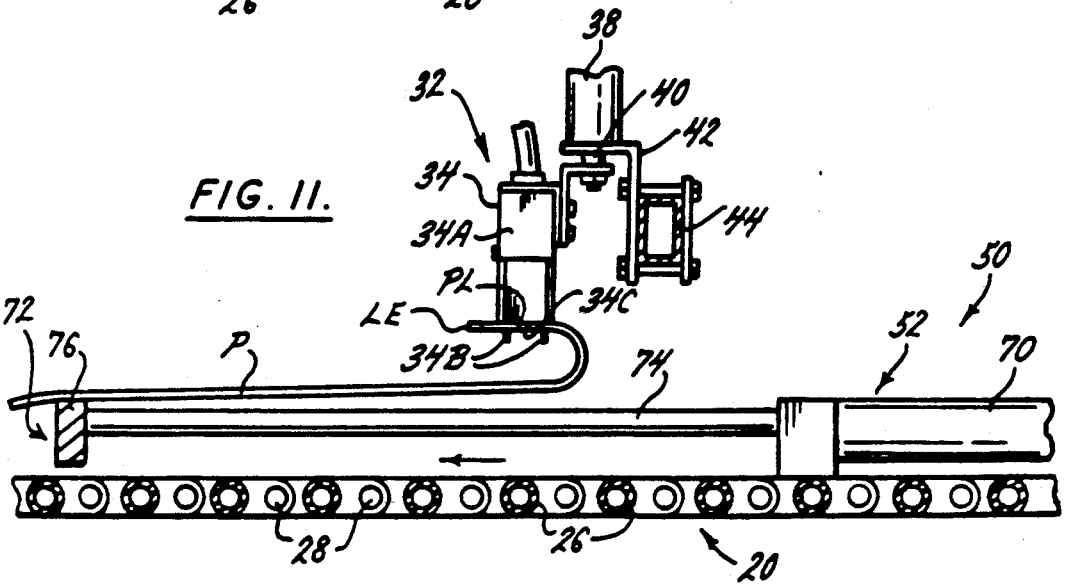

In accordance with this invention, pusher means, generally indicated at 50, is provided for acting on a generally rearwardly facing surface PR of the trailing portion PT or the ply P, and for pushing the trailing portion forwardly to complete the inversion of the trailing portion as the leading edge portion PL is held stationary by the gripper means 32. The five embodiments of the invention, which are discussed separately below, incorporate four forms of pusher means 50. The inverted position of the trailing portion PT is shown in FIGS. 5, 9 and 11. After the trailing portion PT has been inverted, the gripper 34 is adapted to release the leading edge portion PL of the ply from its raised position as the remaining portions of the ply continue to move forwardly on the conveyor. The ply is thus completely inverted and in a position with its leading edge LE rearward of its trailing edge TE, as shown in phantom in FIG. 5.

Referring now to FIGS. 1-5, apparatus of the first embodiment of the present invention is shown. The apparatus includes the conveyor 20 and gripper means 32 substantially as described above. However, the conveyor 20 need not comprise flexible rods 26 mounted on endless chains 24 as described above, but could also, for instance, comprise an endless conveyor belt mounted on rollers. As shown in FIG. 1, the workpiece or "ply" P is supported on the conveyor 20 rearwarldy of the gripper means 23 with its leading edge LE defining the forwardmost (relative to the direction of travel of the ply) extent of the ply and its trailing edge TE defining the rearwardmost extent of the ply. As the leading edge LE moves under the gripper 34, the cylinder 38 is activated to extend its rod 40 downwardly such that the gripping face 34C of the gripper engages or is closely adjacent the leading edge portion PL of the ply (FIGS. 1 and 2). The needles 34B of the gripper are extended to grasp the leading edge portion PL and the cylinder 38 retracts its rod 40, lifting the gripper 34 and the leading edge portion PL off the conveyor 20 (FIG. 3).

Figure 4:
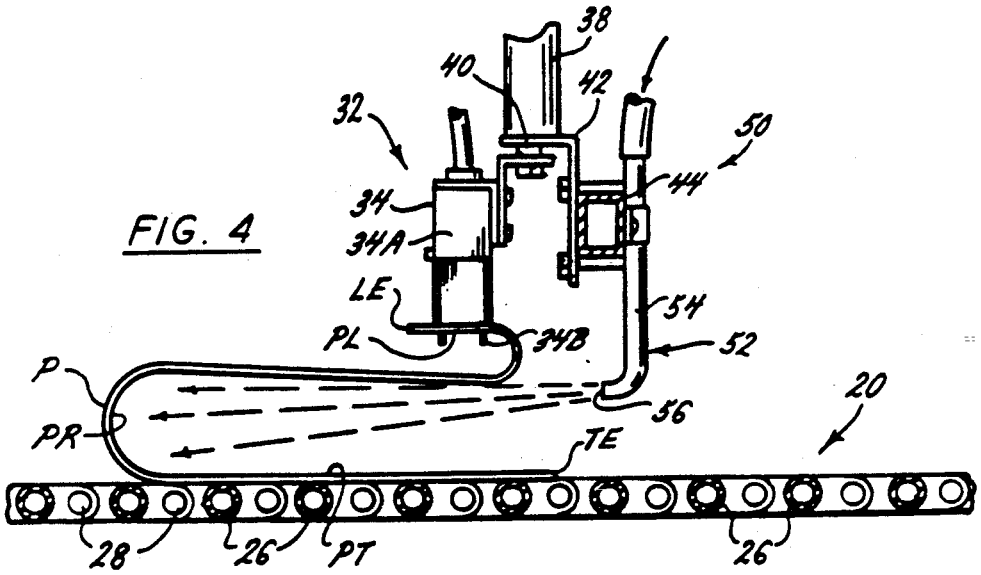

In the first embodiment, the pusher means 50 comprises impulse means 52 including a conduit 54 having an outlet 56 positioned rearwardly of the gripper 34. The conduit 54 is mounted on the support 44 and delivers compressed air from a source of compressed air (shown schematically in FIG. 12). The conduit 54 is adapted to direct a burst of air from the outlet 56 forward against the generally rearwardly facing surface PR of the ply, as illustrated in FIG. 4. The trailing portion PT is pushed forward over the conveyor 20 by the blast of air at a significantly higher speed than the forward rate of travel of the conveyor itself. Therefore, the trailing portion PT of the ply is completely inverted with the trailing edge TE now leading the remaining portions of the ply (FIG. 5). The leading edge portion PL of the ply is then released to drop back to the conveyor 20 in the manner stated above.

Figure 8:
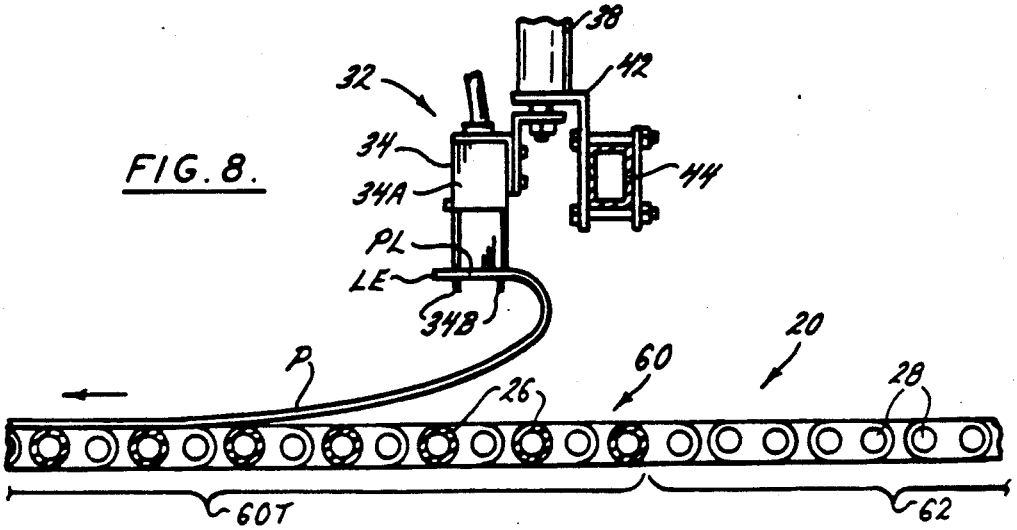

A second embodiment of the present invention is shown in FIGS. 6-8. The apparatus of the second embodiment includes the gripper means 32, exactly as described above. However, the conveyor 20 is made up of a series of flights 60 spaced at intervals with openings 62 between the flights. The conveyor 20 of the first embodiment may be changed to this configuration by removing several of the flexible rods 26 or aluminum slats 30 from the chains 24 at regular intervals to define the flights 60 and openings 62. Each flight 60 is constructed for carrying the workpiece or "ply" P on it with the leading edge LE of the ply generally at the opening 62 which leads the flight and its trailing edge TE rearward of the opening leading the flight.

In the second embodiment, the leading edge portion PL of the ply P is grasped and lifted off the conveyor flight 60 as described above and shown in FIG. 3 with respect to the first embodiment of the apparatus. Although the trailing portion PT initially moves forward beneath the leading edge LE of the ply, the gripper 34 restricts the forward motion of the trailing portion. Therefore, as the flight 60 advances forwardly the trailing edge TE and part of the trailing portion PT fall through an opening 62 between a leading flight 60L (i.e., the flight 60 which initially supports the ply)and a trailing flight 60T (i.e., the flight 60 which trails the flight initially supporting the ply) rearward of the leading flight. In that position, the ply is supported solely by and hangs freely down form the gripper 34, as shown in FIG. 6. The pusher means 50 in the second embodiment comprises a leading surface 66 of the trailing flight 60T (that is, the forward edge of the leading rod in the trailing flight 60T). The leading surface 66 engages the generally rearwardly facing surface PR of the trailing portion, pushing the trailing portion forwardly (FIG. 7). The gripper 34 continues to hold the leading edge portion PL of the ply stationary such that the trailing portion PT moves under and forward of the leading edge LE (FIG. 8), to complete the inversion of the trailing portion. At approximately the time the trailing flight 60T has moved under the trailing edge TE of the ply such that the trailing edge is located on top of the trailing flight, the gripper 34 releases the leading edge portion PL, allowing the leading edge LE of the ply to drop to the trailing flight in a position rearward of the trailing edge and with the ply completely inverted.

Figure 10:
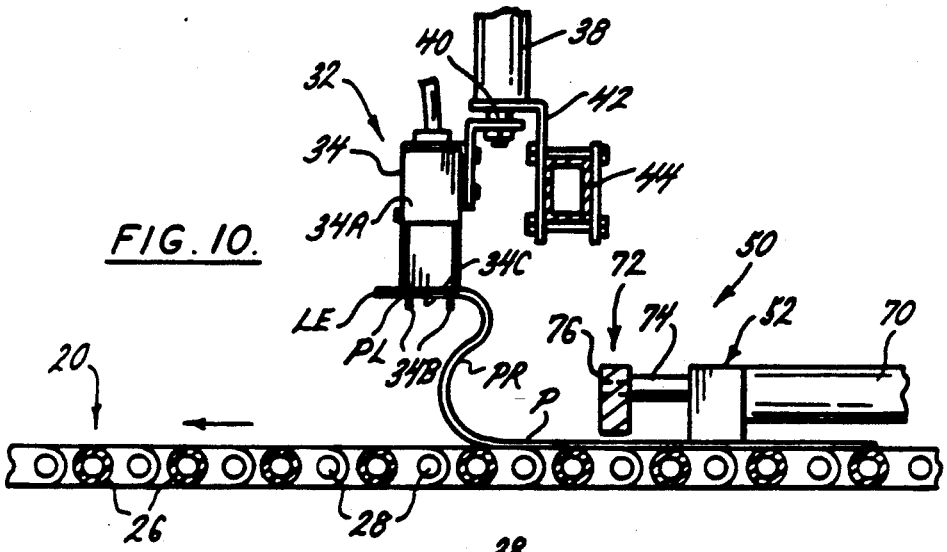
FIGS. 10–11 illustrate inversion of a workpiece of limp sheet material by the apparatus of the third embodiment.

Referring now to FIGS. 9-11, apparatus of a third embodiment is shown to comprise an endless conveyor 20 and gripper means 32 exactly as described above for the first embodiment. However, in this embodiment, the pusher means 50 comprises an air cylinder 70 with an extensible and retractable arm 72 (broadly "impulse means 52"). The cylinder 70 is disposed above the conveyor 20 and to one side thereof with its longitudinal extension parallel to the direction of travel of the conveyor. The ram 72 includes a rod 74 and a pusher bar 76 extending generally transversely across the conveyor 20. The pusher bar 76 is vertically separated from the conveyor 20 by a relatively small distance. As in the previous embodiments, the initial operation of the apparatus involves grasping the leading edge portion PL of the ply with the gripper 34 and lifting the leading edge portion up so that the ply assumes the position shown in FIG. 10. Thereafter, the cylinder 70 is activated to rapidly extend the ram 72 at a significantly greater rate than the rate of travel of the conveyor 20. The pusher bar 76 engages the generally rearwardly facing surface PR of the trailing portion and pushes the trailing portion forwardly underneath the leading edge LE for completely inverting the trailing portion PT (FIG. 11). The rod 74, in its extended position, projects forward of the gripper means 32 nearly the length of the trailing portion PT of the ply so that the trailing portion is fully inverted by the ram 72. The ram 72 is then retracted to its former rearward of the gripper means 32, and the leading edge portion PL is dropped by the gripper 34 as Previously described to complete the inversion of the ply.

Figure 13:
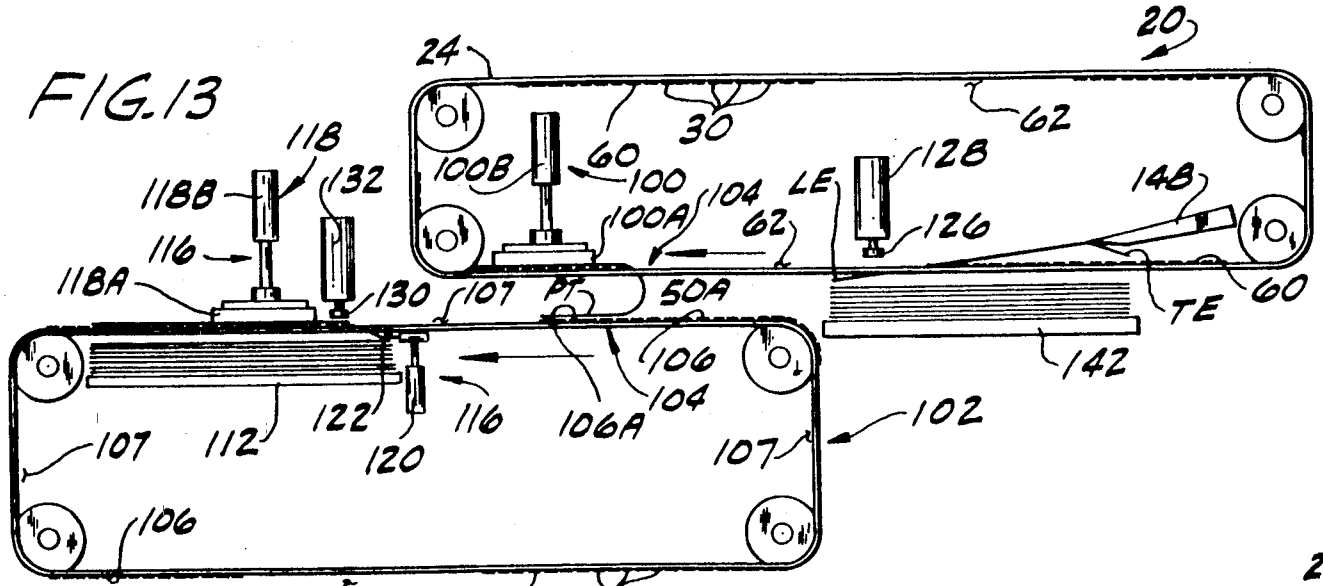
FIG. 13 is a schematic elevation of apparatus of a fourth embodiment.

In a fourth embodiment of the invention, shown schematically in FIG. 13, a primary conveyor 20 is substantially similar to the conveyor described in the second embodiment of the apparatus, including a plurality of flights 60 spaced by openings 62. However.,, in this embodiment, the forward-traveling reach 22 of the conveyor 20 is the lower reach rather than the upper reach, and the (first) gripper means 32 of the apparatus is a wiper member 100 including a wiper pad 100A mounted on the rod of an air cylinder 100B. In addition, the apparatus of the fourth embodiment includes an endless secondary conveyor 102 having a forward-traveling reach 104, at least a portion of which is located under the forward-traveling reach 22 of the primary conveyor 20. As shown in FIG. 13, the secondary conveyor 102 includes a series of flights 106 spaced at intervals along the secondary conveyor with openings 107 between the flights.

The wiper pad 100A and air cylinder 100B of the fourth embodiment correspond to the air cylinder 204 and gripping pad 207 of the second embodiment of the gripping means 74 disclosed in the co-pending, co-assigned U.S. application Ser. No. 580,203 (FIGS. 9 and 10), which is hereby incorporated by reference. Describing the operation of the first gripper means 32 briefly, the air cylinder 100B of the wiper member 100 is operable as a ply P supported on a leading flight 60L of the forward-traveling reach 22 of the primary conveyor passes under the wiper member to extend the wiper pad 100A downward into engagement with the leading edge portion PL of the ply on the flight, as shown in FIG. 13. The wiper pad 100A is made of high friction material such as foamed rubber so that the frictional interaction of the ply P with the wiper pad is greater than that between the ply and the flight 60L so that the ply is held stationary. Thereafter, the leading flight 60L slides forward out from under the ply, and the trailing edge portion PT of the ply falls into the opening between the leading flight and a trailing flight 60T.

In the fourth embodiment, the pusher means 50 comprises a ply engaging surface 106A on the flights 106 of the secondary conveyor 102 acting on the trailing edge portion PT which has fallen through the opening. The ply engaging surface 106A is the upwardly facing surface of the flight 106. However, the engaging surface 106A could also include the leading edge of the flight 106, and it is to be understood that a conveyor having a continuous ply supporting surface, uninterrupted by openings, would also be operable for engaging and inverting the trailing edge portion PT of the plies. The ply engaging surface 106A pushes the trailing edge portion PT of the ply under and forward of the leading edge portion PL, thereby inverting the trailing edge portion of the ply. When the flight 60L moves forward of the forwardmost edge of the wiper pad 100A, the leading edge portion PL is released from the gripper pad 100A and falls to the conveyor flight 106. The ply P is then supported fully on the flight 106 in a flat, inverted position with the leading edge LE of the ply located rearward of the trailing edge TE of the ply.

The secondary conveyor 102 carries the inverted plies P to a stacking station, including a first table 112 for holding a stack of plies. The first table 112 is located under the forward-traveling reach 104 of the secondary conveyor, forward of the first gripper means 32. Transfer of the inverted ply from a flight of the secondary conveyor 102 to a stack on the first table 112 is accomplished by second gripper means 116 comprising a second wiper member 118 located above the first table and the forward-traveling reach 104 of the secondary conveyor. The second gripper means 116 is identical to the second embodiment of the gripping means 74 disclosed in U.S. application Ser. No. 580,203, and similar to the first gripper means 32 disclosed above. The second wiper member 118 includes a wiper pad 118A and an air cylinder 118B for moving the wiper pad into and out of engagement with plies on the flights 106 of the secondary conveyor. Unlike the first gripper means 32, the second gripper means 116 also includes clamping cylinders 120 and hold-down fingers 122 which correspond to the clamping cylinders 210 and extensible and retractable fingers 214 disclosed in U.S. application Ser. No. 580,203 to hold down the stack of plies. The second wiper pad 118A is movable downward into engagement with a ply on a flight 106 passing under the second wiper member 118. The frictional interaction between the wiper pad 118A and the ply P is greater than that between the flight 106 and the ply so that the ply is held stationary and the flight begins to slide out from under the ply. As this occurs, the ply falls P onto the stationary first table 112 and lies flat on top of the stack of plies already on the table. The first table 112 is mounted for vertical movement on a ball screw mechanism (not shown) and controlled by the controller 80 for automatic movement downward as the stack of plies on the first table gets larger. Further details of the stacking operation and the movement of the first table are disclosed in U.S. application Ser. No. 580,203.

The apparatus as shown in FIG. 13 can be used to place a shade number on the inside face of the plies P (i.e., the face which will be on the inside of the article of apparel). The stack of plies cut from the spread includes plies which alternately have their inside and outside (i.e., "first and second") faces facing upward. Therefore, in order to mark all plies on their inside faces, it is necessary that some be inverted before marking, while others do not require inversion. A first shade numbering device 126 is located above the forward-traveling reach 22 of the primary conveyor 20 and rearward of the first gripper means 32. In this embodiment, the shade numbering device 126 is the Tovel Model TPG Dual Line Printer made by Tovel SPA of Venezia, Italy, and available in this country through Tennessee Imports, Inc. of Nashville, Tenn. The shade numbering device 126 is mounted on an air cylinder 128 which is operable to extend the device through an opening between adjacent flights 60 of the conveyor 20 for applying a self-adhesive sticker (not shown) to the upwardly facing inside face of the top ply in the stack. It is to be understood that other types of marking devices, such as those which mark the plies with ink, may also be used and still fall within the scope of this invention.

A second shade numbering device 130, identical to the first shade numbering device, is mounted on an air cylinder 132 above the forward-traveling reach 104 of the secondary conveyor, forward of the first gripper means 32. The cylinder 132 can move the device 130 through openings between the flights 106 of the secondary conveyor to apply a self-adhesive sticker (not shown) to the inside faces of plies which face upward after inversion of the plies by the apparatus.

Figure 14:
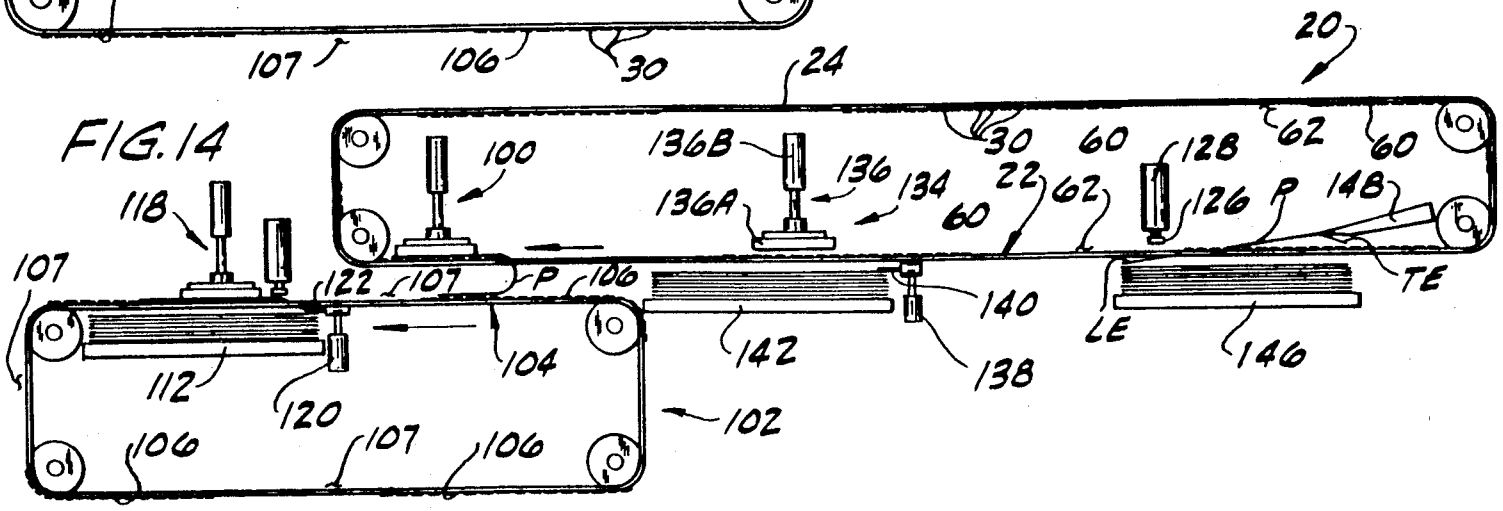
FIG. 14 is a schematic elevation of apparatus of a fifth embodiment of the present invention, which apparatus separates and selectively inverts plies.

A fifth embodiment of the invention is shown in FIG. 14 to include third gripper means 134 comprising a third wiper member 136 having a wiper pad 136A mounted on an air cylinder 136B, clamping cylinders 138 and a hold-down fingers 140. The clamping cylinders 138 and hold-down fingers 140 are the same as the clamping cylinders 120 and hold-down fingers 122 of the second gripper means 116, described above. The apparatus further includes a second means for holding a stack comprising a second table 142 located under the forward-traveling reach 22 of the primary conveyor 20 rearward of the first gripper means 32. The second table 142 holds the stack of plies which are initially oriented with their inside faces facing upward, and therefore are numbered by the first shade numbering device 126 prior to reaching the first gripper means 32. The first table 112 holds the stack of plies initially oriented with their inner faces facing down. These plies are inverted by the first wiper member 100, as described above for the fourth embodiment, stacked, and marked by the second shade numbering machine 130. Where the ply pattern is asymmetric and the plies cut are either left or right plies, these plies are segregated by the apparatus from a single stack into stacks of exclusively left or right plies on the first and second tables 112, 142.

The apparatus of both the fourth and fifth embodiments includes third means for holding a stack of workpieces comprising a third table 146 located under the forward-traveling reach 22 of the primary conveyor 20, rearward of the second table 142. Means, including a picker 148, transfers plies one at a time and one after another from the stack of plies supported on the third table 146 to one of the flights of the conveyor. The picker 148 is substantially the same as the pick-up means 49 shown and described in the co-pending, co-assigned U.S. application Ser. No. 445,539, filed Dec. 4, 1989, which is incorporated herein by reference. The picker 148 is commercially available, sold under the trademark CLUPICKER by Jet Sew of Barneveld, N.Y. Reference may be made to U.S. Pat. No. 4,157,823, which is incorporated herein by reference, for full details of the picker. The picker may also be a Walton picker (not shown) manufactured by Robotic Systems & Components Co., and available through PickRobotics of Whitinsville, Mass. For a disclosure of the details of the Walton picker, reference is made to U.S. Pat. No. 4,645,193, which is incorporated herein by reference. Generally, the picker 148 pivots downwardly through an opening between adjacent flights 60 and picks up a leading edge portion PL of the top ply in the stack. The oncoming flight, as illustrated in FIG. 13, wipes between the top ply and the next ply in the stack to complete the separation of the top ply from the stack. The picker 148 releases the trailing edge portion PT when the leading edge portion PL is fully supported on the flight so that the trailing edge portion falls to the flight 60 and is carried forward on the flight.

Figure 12:
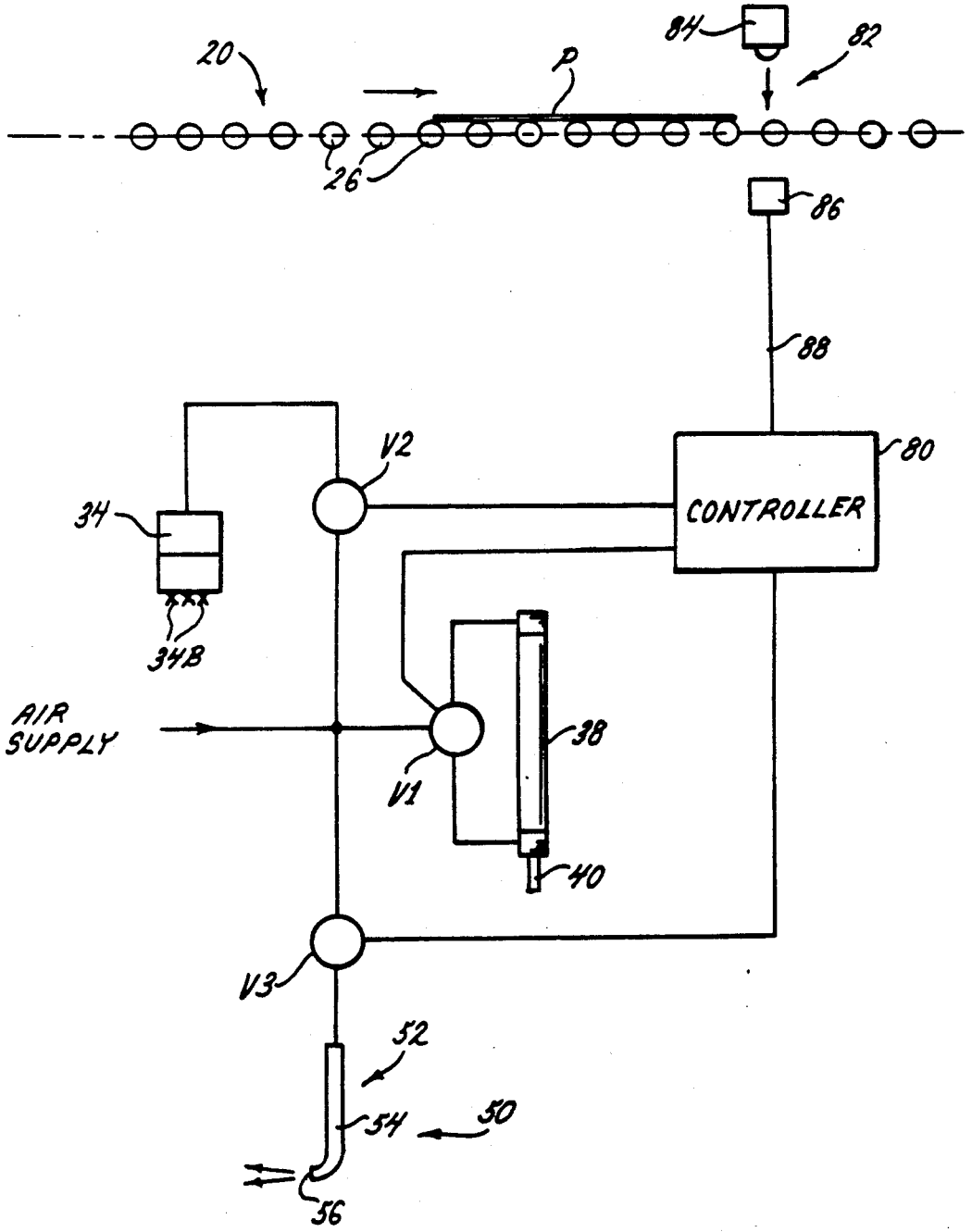
FIG. 12 is a diagrammatic view illustrating circuitry of the apparatus.

The apparatus is under control of a programmable controller, such as indicated at 80 in FIG. 12, which may be a Shark X-903 controller sold by Reliance Electric Corp. through their dealers in major cities. In the first embodiment of the present invention, the controller controls the valve V1 for the air cylinder 38, the valve V2 for the gripper 34, and the valve V3 for the impulse means 52. In the apparatus of the second embodiment, the controller 80 similarly controls the air cylinder 38 and gripper 34; there is no impulse means 52, and thus no valve for controlling the same. At 82 is indicated means for sensing the passage of a ply P over a point rearward of the gripper means 32, this means being an electric eye means having a light source 84 which projects a beam of light toward the upper reach 22 of the conveyor ,the beam impinging on an electric eye 86 except when a ply passes between the light source and eye. The eye means 82 is of the type having a built-in delay so that it is not activated by the passage of the rods 26 making up the conveyor 20 (or conveyor flights 60) through the beam. Another type of commercially available sensing means may be employed where the conveyor is opaque. The eye means 82 is activated by passage of the trailing edge TE of the ply such that a beam of light from light source 84 again impinges upon the electric eye 86 which then transmits a signal tot he controller 80 over a line 88 to initiate a cycle of operation of the gripper means 32. Under control of the controller 80 the valve V1 of the air cylinder 38 is activated to actuate the cylinder to extend the rod 40 downward form tis raised position (shown in phantom in FIG. 1), bringing the gripping face 34C of the gripper 34 into engagement with the leading edge portion PL of the ply (as shown in solid lines in FIG. 1). Valve V2 is then activated to actuate the gripper 34 to extend the needles 34B from the gripper body 34A to grasp the ply, and valve V1 is reactivated to actuate the cylinder 38 to lift the gripper and the leading edge portion PL off the conveyor 20 (FIG. 3). The impulse means 52 discharges its blast of air against the generally rearwardly facing surface PR of the trailing portion PT of the ply by activation of the valve V3 by the controller 80 (FIG. 4). After the discharge of a burst of air by the impulse means 52, the valve V2 is reactivated to retract the needles 34B into the gripper body 34A, releasing the leading edge portion PL which drops to the conveyor 20. The ply P is thus inverted with the leading edge LE rearward of the trailing edge TE. The control of the impulse means 52 and the release of the leading edge portion PL by the gripper 34 is on a time basis. However, the initial downward and grasping movement of the gripper means 32 is set to occur immediately after the controller 80 receives the signal from the eye means 82. Therefore, it is necessary initially to position the eye means 82 relative to the gripper means 32 so that the gripper 34 will engage the leading edge portion PL of the ply.

The cycle of operation for the apparatus of the second embodiment, with the exception of the operation of impulse means 52, which is not present in the second embodiment, is the same as for the first embodiment. The circuitry of the apparatus of the third embodiment is more nearly like that of the first embodiment. It differs only in that the impulse means 52 comprises the air cylinder 70 and ram 72; however, the timing of the air blast from conduit 54 and the rapid extension of the ram from the air cylinder 70 is the same.

Figure 15:
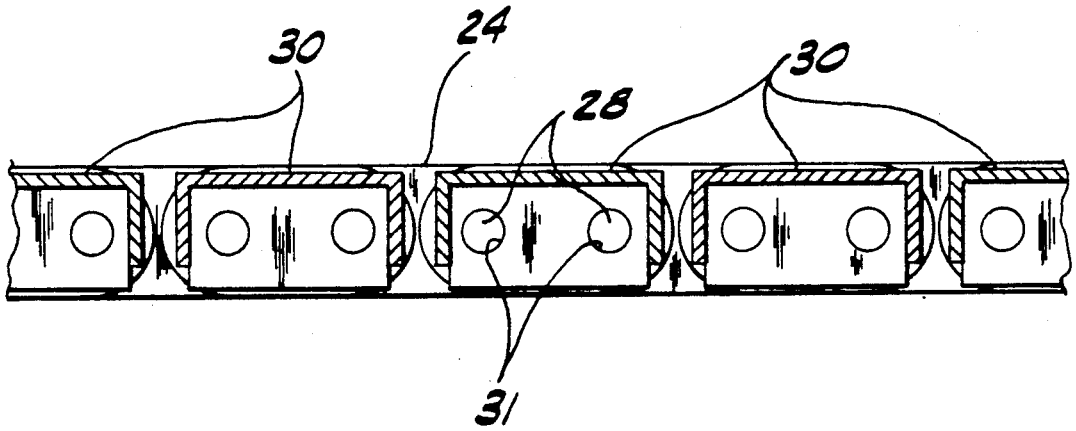
FIG. 15 is a fragmentary longitudinal section of the conveyor showing slats forming part of the conveyor.
Figure 16:
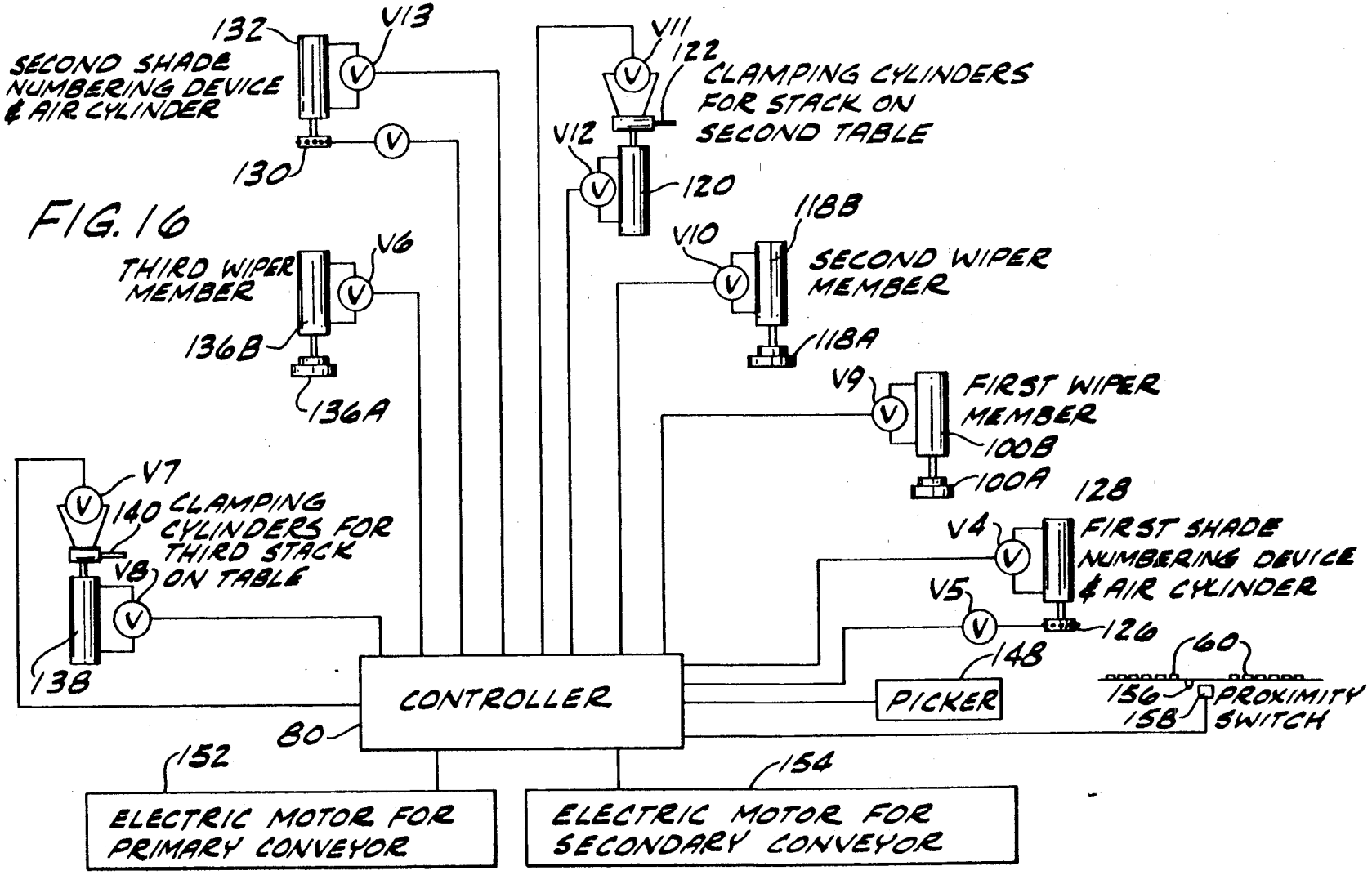
FIG. 16 is a schematic showing the connection of a controller to components of the apparatus of the fifth embodiment.

The same controller 80 is used to control the cycle of operation of the fourth and fifth embodiments of the apparatus. A schematic of the connection of the controller to the various components of the fifth embodiment of the apparatus is shown in FIG. 15. The controller 80 operates valves V4-V14 and electric motors, indicated by reference numbers 152 and 154, respectively, for driving the primary and secondary conveyors 20, 102. Thus, it may be seen that all of the components of the apparatus are controlled by the controller 80 for synchronous operation. A cam 156 on one of the conveyor chains 24 of the primary conveyor 20 trips a proximity switch 158 at a position rearward of the picker 148 for signalling the controller to begin a cycle of operation. Initially, the controller 80 is set so that if the top ply in the stack on the third table 146 is disposed with its inside face upward, operation begins, upon signal from the proximity switch 156, with actuation of valve V4 controlling the shade numbering cylinder 128 to extend the first shade numbering device 126 through the opening 62 between adjacent flights 60 and into engagement with the top ply of the stack supported on the third table 146. It is to be understood that the shade numbering device 126 can also mark the plies as they rest on a conveyor flight 60. The valve V5 is actuated by the controller 80 so that the shade numbering device 126 places a sticker on the inside face of the top ply. The operation is timed so that the movement of the shade numbering device 126 coincides with the passage of the opening under the shade numbering device. The shade numbering device 126 is then retracted on command from the controller 80 to the valve V4 to make way for the oncoming flight 60. The controller 80 does not again activate the first shade numbering device 126 until the next ply in the stack has been transferred to a flight 60 and carried away, and another ply with its inside face facing upward is at the top of the stack. Of course, if the stack on the third table 146 initially has a top ply oriented with its outside face facing upward, the controller 80 can be set not to actuate the first shade numbering device 126 until the top ply has been carried away.

The signal from the proximity switch 158 also causes the controller 80 to activate the picker 148 so that the picker swings down through an opening 62, grasps a trailing edge portion PT of the top ply and lifts it back up through the opening. The flight 60 trailing the opening 62 wipes between the top ply and the remaining plies in the stack to separate the ply from the stack, and the controller 80 then causes the picker 148 to release the trailing edge portion PT of the ply so that it falls to the flight. The third table 146 is mounted for vertical movement on a ball screw mechanism (not shown) and controlled by the controller 80 for automatic movement upward as the stack of plies on the third table gets smaller as plies are removed. The timing of operation of the third wiper member 136, like the first shade numbering device 126, is set by whether the top ply in the stack on the third table 146 is initially oriented with its inside face facing up or down in the stack. If the inside face is facing up, the controller 80 activates valve V6 to actuate the third wiper member 136 by causing the wiper cylinder 136B to move the wiper pad 136A downward into engagement with the ply on the flight 60 so that the ply is deposited on the second table 142. The clamping cylinder 138 and hold-down finger 140 operate in the same way as the corresponding components described in application Ser. No. 580,203. The controller 80 activates the valve V7 to retract the finger 140 from the top ply of the stack, and the valve V8 for the clamping cylinder 138 is activated to move the finger upward. The valve V7 is then reactivated to extend the finger 140, and the clamping cylinder valve V8 is activated to move the finger down into engagement with the stack, on top of the ply just deposited on the second table 142. The second table 142, like the first table 112, is mounted for vertical movement on a ball screw mechanism (not shown) and controlled by the controller 80 for automatic movement downward as the stack of plies on the second table gets larger. Further details of the stacking operation and the movement of the second table are disclosed in U.S. application Ser. No. 580,203.

Plies oriented on the primary conveyor flights 60 with their outer faces facing upward, pass under the third wiper member 136 and toward the first wiper member 100. The controller 80 controls the first wiper member 100 so that it does not operate as the first flight 60, which was emptied of its ply by the third wiper member 136, passes under the first wiper member. However, coinciding with the passage of the next flight 60 under the first wiper member 100, the controller activates valve V9 to extend the wiper pad 100B down into engagement with the ply on the flight 60. Inversion of the ply, and its transfer to one of the flights 106 of the secondary conveyor 102 then occur as described above.

Activation of the second wiper member 118 is withheld by the controller 80 as the first (empty) flights 106 pass under the wiper pad 118A. However, valve V10 is activated to bring the wiper pad 118A down into engagement with the ply on the first flight carrying a ply P for stacking the ply on the first table 112. The operation of valves V11 and V12 to control the hold-down fingers 122 and the clamping cylinders 120 are the same as stated above for the hold-down fingers 140 and clamping cylinders 138 of the third gripper means 134. The valve V13 is activated to cause the second shade numbering cylinder 132 to extend the second shade numbering device 130 through the opening between flights 106 and into engagement with the top ply in the stack supported on the first table 112. The controller then activates valve V14, actuating the second shade numbering device 130 for applying a sticker (not shown) on the upward facing inner face of the inverted ply P. It will be noted that the fifth embodiment also serves the function of separating the plies P into two stacks of like (left and right) Plies on the second and third tables 142, 146.

The operation of the apparatus of the fourth embodiment is substantially similar to that of the fifth embodiment. However, the fourth embodiment lacks the third wiper member 136 and second table 142 so that every ply is inverted and stacked on the first table 112 beneath the secondary conveyor 102. The first and second wiper members 100, 118 are activated by the controller 80 for every flight, starting with the first flight (60 or 106) carrying a ply P which passes under each wiper member. The shade numbering devices 126, 130 will be operated for every other ply so that only the inner face of the plies receive a shade number.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for automatically inverting workpieces of limp sheet material, such as fabric sheet material, the apparatus comprising, an endless primary conveyor having a forward-traveling reach for conveying workpieces in a forward direction, each workpiece having a leading edge and a trailing edge, gripper means for engaging a portion of the workpiece generally adjacent its leading edge as the workpiece travels on the primary conveyor and holding said leading edge portion stationary, the primary conveyor comprising a series of flights spaced at intervals therealong with openings between the flights, each flight being adapted to support a workpiece, said trailing edge and at least a portion of the workpiece, generally adjacent its trailing edge dropping through an opening between the flight supporting the workpiece and a trailing flight after said gripper means has engaged and held stationary said leading edge portion of the workpiece, pusher means adapted to act on said trailing edge portion of the workpiece for pushing said trailing edge portion forwardly to invert said trailing edge portion, said leading edge portion of the workpiece being released from said gripper means after said trailing edge portion of the workpiece has been inverted, whereupon the workpiece is in a generally flat, inverted position wherein said leading edge is rearward of said trailing edge.

2. Apparatus as set forth in claim 1 wherein said apparatus further comprises an endless secondary conveyor having a forward-traveling reach at least a portion of which is located under the forward-traveling reach of the primary conveyor, and wherein said pusher means comprises a workpiece engaging surface on the forward-traveling reach of the secondary conveyor, said workpiece engaging surface being adapted to engage said trailing edge portion of the workpiece and move said trailing edge portion forward as said leading edge portion is held stationary by said gripper means thereby inverting said trailing edge portion.

3. Apparatus as set forth in claim 2 wherein said gripper means comprises a wiper member including a pad made of high friction material for engaging a workpiece, the portion of the workpiece engaged by the pad being held stationary so that the flight supporting the workpiece slides out from under the workpiece.

4. Apparatus as set forth in claim 1 further comprising control means activating said wiper member to engage the workpiece on the passage of the workpiece thereunder.

5. Apparatus for automatically inverting and marking workpieces of limp sheet material, such as fabric sheet material, from a stack of workpieces, each workpiece having a first face and a second face and a leading edge and a trailing edge, the apparatus comprising, an endless primary conveyor having a forward-traveling reach for conveying workpieces in a forward direction, the primary conveyor comprising a series of flights spaced at intervals therealong with openings between the flights, the flights being adapted to support the workpieces, an endless secondary conveyor having a forward-traveling reach for conveying workpieces in a forward direction, at least a portion of the forward-traveling reach of the secondary conveyor being located under the forward traveling reach of the primary conveyor, the secondary conveyor comprising a series of flights spaced at intervals therealong with openings between the flights, first gripper means for engaging a portion of the workpiece generally adjacent its leading edge and holding said leading edge portion stationary, said trailing edge and at least a portion of the workpiece generally adjacent its trailing edge dropping through an opening between the primary conveyor flight supporting the workpiece and a trailing flight after said first gripper means has engaged and held stationary said leading edge portion of the workpiece, pusher means, comprising workpiece engaging surfaces on the flights of the secondary conveyor, adapted to act on said trailing edge portion of the workpiece for pushing said trailing edge portion forwardly to invert said trailing edge portion, said leading edge portion of the workpiece being released from said first gripper means after said trailing edge portion of the workpiece has been inverted, whereupon the workpiece is in a generally flat, inverted position on a flight of the secondary conveyor with said leading edge located rearward of said trailing edge, first means located above the forward-traveling reach of the primary conveyor and rearward of said first gripper means for marking with an identifying reference mark workpieces having their first faces facing upward prior to inversion thereof, and second means located above the forward-traveling reach of the secondary conveyor and forward of said first gripper means for marking with an identifying reference mark workpieces having their first faces facing upward subsequent to inversion thereof.

6. Apparatus as set forth in claim 5 further comprising first means for holding a stack of workpieces located under the forward-traveling reach of the secondary conveyor, and second gripper means for engaging a portion of the workpiece as the workpiece travels on the secondary conveyor and holding the workpiece stationary, whereby the flight on which the workpiece rests slides out from under the workpiece and the workpiece is deposited on said first means for holding a stack.

7. Apparatus as set forth in claim 6 further comprising second means for holding a stack located under the forward-traveling portion of the primary conveyor rearward of said first gripper means, and third gripper means for engaging and holding stationary a portion of the workpiece on the primary conveyor flight, whereby the flight slides out from under the workpiece and the workpiece is deposited on said second means for holding a stack.

8. Apparatus as set forth in claim 7 further comprising third means for holding a stack of workpieces located under the forward-traveling reach of the primary conveyor rearward of said second means for holding a stack, and means for transferring workpieces one at a time and one after another from a stack of workpieces held by said third means for holding a stack to a flight of the primary conveyor.

9. Apparatus for automatically inverting and separating workpieces of limp sheet material, such as fabric sheet material, from a stack of workpieces, each workpiece having a first face and a second face and a leading edge and a trailing edge, the apparatus comprising, an endless primary conveyor having a forward-traveling reach for conveying workpieces in a forward direction, the primary conveyor comprising a series of flights spaced at intervals therealong with openings between the flights, the flights being adapted to support the workpieces, an endless secondary conveyor having a forward-traveling reach for conveying workpieces in a forward direction, at least a portion of the forward-traveling reach of the secondary conveyor being located under the forward traveling reach of the primary conveyor, the secondary conveyor comprising a series of flights spaced at intervals therealong with openings between the flights, first gripper means for engaging a portion of the workpiece generally adjacent its leading edge and holding said leading edge portion stationary, said trailing edge and at least a portion of the workpiece generally adjacent its trailing edge dropping through an opening between the primary conveyor flight supporting the workpiece and a trailing flight after said first gripper means has engaged and held stationary said leading edge portion of the workpiece, pusher means, comprising workpiece engaging surfaces on the flights of the secondary conveyor, adapted to act on said trailing edge portion of the workpiece for pushing said trailing edge portion forwardly to invert said trailing edge portion, said leading edge portion of the workpiece being released from said first gripper means after said trailing edge portion of the workpiece has been inverted, whereupon the workpiece is in a generally flat, inverted position on a flight of the secondary conveyor with said leading edge located rearward of said trailing edge, first means for holding a stack of workpieces located under the forward-traveling reach of the secondary conveyor, second gripper means for engaging a portion of the workpiece as the workpiece travels on the secondary conveyor and holding the workpiece stationary, whereby the flight on which the workpiece rests slides out from under the workpiece and the workpiece is deposited on said first means for holding a stack, second means for holding a stack located under the forward-traveling portion of the primary conveyor and rearward of said first gripper means, and third gripper means for engaging a portion of the workpiece as the workpiece travels on the primary conveyor flight and holding the workpiece stationary, whereby the flight slides out from under the workpiece and the workpiece is deposited in a stack on said second means for holding a stack.

10. Apparatus as set forth in claim 9 further comprising third means for holding a stack of workpieces located under the forward-traveling reach of the primary conveyor and rearward of said second means for holding a stack, and means for transferring workpieces one at a time and one after another from a stack of workpieces held by said third means for holding a stack to a respective flight of the primary conveyor.

* * * * *